United States Patent [19]

Dokos et al.

[11] Patent Number: 4,742,942

[45] Date of Patent: May 10, 1988

[54] FOAM PRODUCING MALT BEVERAGE FAUCET

[75] Inventors: John H. Dokos, St. Louis; James Teng, Crestwood, both of Mo.; Hines James, Vernon, N.J.

[73] Assignee: Anheuser-Busch Companies, Inc., St. Louis, Mo.

[21] Appl. No.: 755,701

[22] Filed: Jul. 16, 1985

Related U.S. Application Data

[63] Continuation-in-part of Ser. No. 735,443, May 17, 1985, Pat. No. 4,610,888.

[51] Int. Cl.[4] ..... B65D 25/40

[52] U.S. Cl. ..... 222/501; 222/547; 222/564; 137/600; 137/601

[58] Field of Search ..... 137/600, 601, 599.2; 222/4, 501, 547, 564, 402.1, 402.12, 402.25, 476, 505, 509, 559; 138/40, 44; 239/590.3, 596

[56] References Cited

U.S. PATENT DOCUMENTS

| | | | |
|---|---|---|---|
| 53,692 | 4/1866 | Sirret . | |
| 688,586 | 2/1901 | Brake . | |
| 936,462 | 10/1909 | Levin . | |
| 1,623,597 | 4/1927 | Humphrey . | |
| 1,646,916 | 10/1927 | Lamarque et al. . | |
| 2,028,283 | 1/1936 | Howard et al. | 225/8 |
| 2,034,623 | 3/1936 | Kraft | 225/8 |
| 2,039,564 | 5/1936 | Smith | 225/9 |
| 2,109,978 | 3/1938 | Seitz et al. | 225/9 |
| 2,125,248 | 7/1938 | Taylor | 225/40 |
| 2,160,501 | 5/1939 | Hedges et al. | 225/1 |
| 2,208,611 | 7/1940 | Taylor | 225/41 |
| 2,220,877 | 11/1940 | Gordon | 225/5 |
| 2,310,313 | 2/1943 | Pivert | 225/6 |
| 2,327,444 | 8/1943 | Nigbor | 225/6 |
| 2,355,205 | 8/1944 | Daun | 137/600 |
| 2,371,028 | 3/1945 | Christ | 225/9 |
| 2,373,294 | 4/1945 | Cornelius | 137/600 |
| 2,510,395 | 6/1950 | Goodrie | 239/590.3 |
| 2,675,822 | 4/1954 | Redlin | 137/170.3 |
| 2,707,624 | 5/1955 | Shames et al. | 261/76 |
| 3,084,718 | 4/1963 | Ash | 138/44 X |
| 3,233,631 | 2/1966 | Cornelius | 137/600 |
| 3,761,066 | 9/1973 | Wheeler | 261/78 |

FOREIGN PATENT DOCUMENTS

| | | | |
|---|---|---|---|
| 1261384 | 1/1972 | United Kingdom | 137/600 |

OTHER PUBLICATIONS

Making Nitrogen In-House for Irish Stout-Brewing & Distilling International—Nov. 1984.

Putting the Cream Topping—Brewing & Distilling International Dec. 1984.

*Primary Examiner*—Joseph J. Rolla

*Assistant Examiner*—David H. Bollinger

*Attorney, Agent, or Firm*—Gravely, Lieder & Woodruff

[57] ABSTRACT

A faucet for dispensing flat malt beverage and a smooth, creamy and stable foam having a shiftable faucet shaft which in one position dispenses flat beer and in a second position provides an alternate flow path through restricted orifices which increase the velocity of the malt beverage so that it draws air into the faucet housing through orifices therein and incorporates the air into the foam to dispense a stable, creamy foam from the faucet discharge port.

3 Claims, 2 Drawing Sheets

FOAM PRODUCING MALT BEVERAGE FAUCET

REFERENCE TO PRIOR APPLICAITONS

This application is a continuation-in-part of copending application Ser. No. 735,443 filed May 17, 1985, now U.S. Pat. No. 4,610,888 of co-inventors James Teng and John H. Dokos.

BACKGROUND OF THE INVENTION

The invention relates to the field of beer dispensing and beer dispensing apparatus and, in particular, relates to a faucet for stabilizing foam draft beer as it is dispensed.

In the art of making beer, it is very important that the appearance of the beer in the glass be attractive to the user. While flavor is the aspect most talked about in beer, appearance is the first thing noticed by the customer and that makes it important. The shade and depth of color, the clarity, beading, type of head foam, the foam retention, and the foam cling, all contribute to making the initial impression. It is desirable that the foam atop a glass of beer dispensed from a faucet be smooth, creamy, be relatively stable and have an attractive taste. The incorporation of air into beer as it is dispensed at the faucet spout gives a head of very fine bubbles with excellent stability and a creamy slightly sweet desirable taste.

In application Ser. No. 735,443, there is disclosed a process and apparatus for incorporating air into beer after it leaves a conventional faucet spout by passing the beer through a perforated plate with small openings which break up the beer into smaller high velocity streams which pull air into the beer streams utilizing a Venturi effect. The pressure drop across the perforated plate starts the foaming process and the mixed beer, $CO_2$ foam, and air is then passed through a screen to form small stable bubbles which result in the desired smooth, creamy and stable foam.

In Ser. No. 735,443 there is described the history of the efforts to dispense Irish stout and English beer with a desired head. These procedures were not totally successful, and some use nitrogen which result in additional expense. Several of the processes require the use of high pressure kegs, which, in turn, necessitates heavier duty installation in the pub.

Currently there are on the market so-called push back foam causing faucets, which work on the principle of restricting the beer at the valve seat, usually through on or two apertures on the shaft. These devices are believed to operate on the foaming caused by the pressure drop across the shaft wall and do not incorporate additional air or nitrogen into the foam.

These type devices, moreover, are not capable of producing a satisfactory type foam on the new light beers. The foam does not form a tight head and the foam "falls off", i.e., it goes flat quickly.

Accordingly, it is a principal object of this invention to provide a dispensing faucet which when in a first position will dispense flat beer and when in a second position will dispense a smooth, creamy and stable foam.

Furthermore, it is an object of this invention to provide a faucet which will dispense a stable, thick foam on a conventional "light-type" beer.

It is another important object of this invention to provide a beer dispensing faucet in which air is drawn into a stream of finely divided jets of beer, turbulence in the stream is created to mix the air into the beer, and a beer foam is dispensed which is comprised of bubbles of very small diameter, which foam is extremely stable over a period of time. This faucet is capable of creating this foam even with the light-type beers presently sold in this country. This faucet also is capable of dispensing flat beer so that the single faucet can dispense a glass of beer having a head of a smooth, creamy foam which is stable and long lasting.

These and other objects and advantages will become apparent in the drawings and description hereinafter set forth.

SUMMARY OF THE INVENTION

This invention comprises an apparatus for forming a stable, creamy foam from a malt beverage utilizing a unique dispensing faucet capable of dispensing flat beer and of incorporating air into the beer in the faucet prior to entering the receptacle from which it is to be drunk.

DESCRIPTION OF THE DRAWINGS

In the drawings where like numerals refer to like parts wherever they occur

DETAILED DESCRIPTION

It is the general practice and custom in the brewing industry to exclude all possible air from contact with beer because of the known oxidizing effect of air on beer. Oxygen, when in contact with beer for periods of time, tends to cause off flavors, etc. Accordingly, the incorporation of air into beer is contrary to present practices, but when added immediately prior to the beer entering the glass, the known deleterious effects are avoided.

CONSTRUCTION

Figure 1:
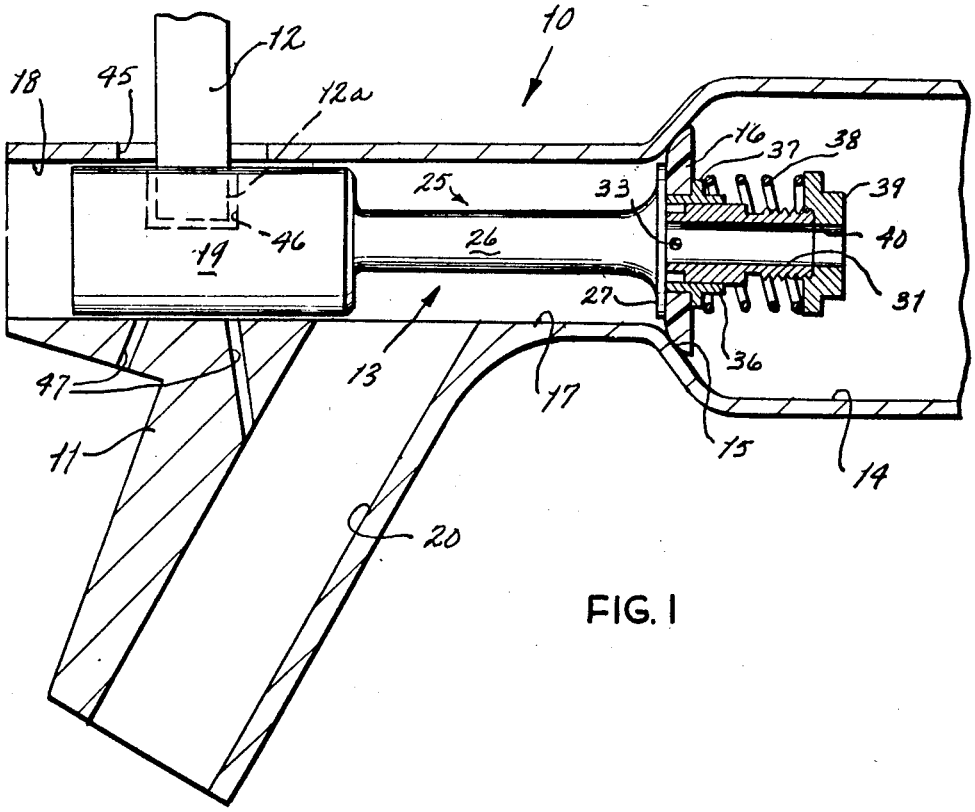
FIG. 1 is a vertical partly sectional view of the dispensing faucet of this invention at the shut-off position.

FIG. 1 shows the beer dispensing faucet 10 of this invention in its "off" position. The faucet 10 consists of a body 11, an actuator handle 12 and a faucet shaft 13.

The body 11 includes an enlarged chamber 14 connected to a supply of pressurized malt beverage and terminating in an internal shoulder 15 which functions as a valve seal for the valve seat 16, which is made from an elastomeric material. Connected to the shoulder 15 is a reduced main passage 17 which includes a guide chamber 18 for a cylindrical end member 19 of the faucet shaft 13. A discharge port 20 intersects the main passage 17 at approximately a 60° angle and allows the malt beverage to flow from the faucet 10.

Figure 4:
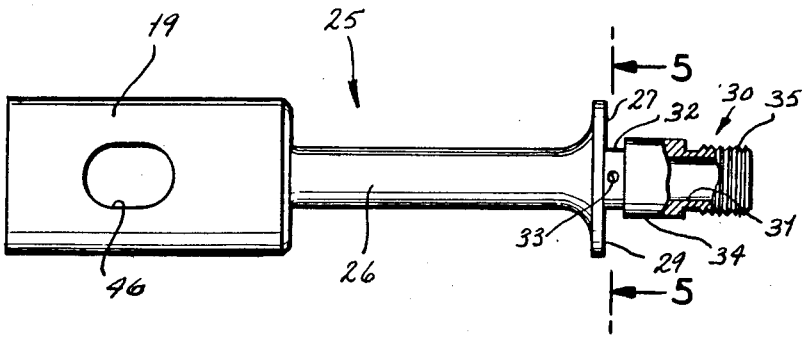
FIG. 4 is a plan view, partly in section of the faucet shaft of this invention.
Figure 5:
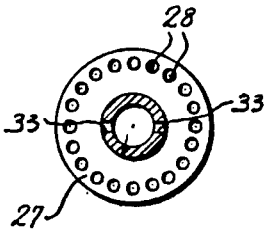
FIG. 5 is a sectional view taken along line 5—5 of FIG. 4.

The faucet shaft 13 comprises a stem 25 (shown in FIGS. 4 and 5) which includes the cylindrical guide member 19 which fits loosely in the faucet chamber 18 and reciprocates back and forth therein and serves to align the shaft mechanism 13 in the body 11. A reduced shaft 26 connects the guide member 19 to a valve seat retaining flange 27 which is a critical and essential feature of this invention. The flange 27 reciprocates freely in the main passage 17 and is provided with a series of homogenizing passages 28 around its periphery. The openings 28 are from 0.010 to 0.040 inches in diameter.

Connected to the rear face 29 of the flange 27 is a tubular member 30 which has an internal passage 31 terminating in the flange rear face 29. The tubular member 30 has a reduced circumferential area 32 adjacent to the flange rear face 29 which contains two ports 33 connecting the reduced area 32 to the internal passage 31. An enlarged spring retainer bearing area 34 connects to the reduced portion and terminates in a threaded portion 35.

Referring back to FIG. 1, the faucet shaft 13 further includes the valve seat 16 which is mounted on a spring retainer 36. The spring retainer 36 is longitudinally slidably positioned on the valve stem bearing area 34 and has a circumferential flange 37 which separates a return spring 38 from the seat 16. An end cap 39 is threaded onto the faucet shaft threaded portion 35 and retains the spring 38 on the stem 25. The end cap 39 has a throughbore 40 which connects to the stem passage 31.

The handle 12 is loosely positioned in an elongated opening 45 in the body 11. An end 12*a* of the handle 12 is loosely positioned in a slot 46 in the faucet shaft cylindrical guide member 19. Longitudinal movement of the handle 12 moves the stem 25 through the positions of FIGS. 1, 2 and 3, i.e., from shut-off (FIG. 1) to flat beer dispensing (FIG. 2) to foam dispensing (FIG. 3) positions.

Figure 3:
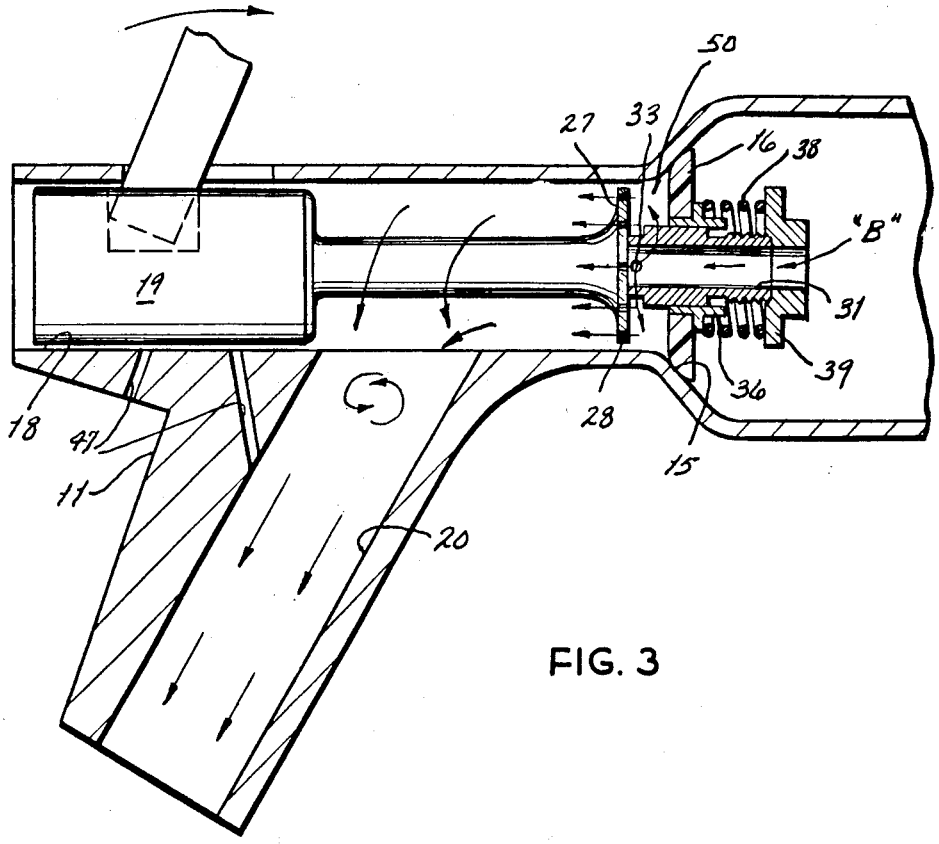
FIG. 3 is a view similar to FIGS. 1 and 2 except that the valve is in its full backward position to dispense a stable, creamy foam.

The body 11 also includes one or more vents 47 to admit air (along with the air which enters through the loose fit of the faucet shaft guide member 19 in the body chamber 18) to the body interior 17,20 where it is mixed with beer when the faucet shaft 13 is in the position of FIG. 3.

OPERATION

Figure 2:
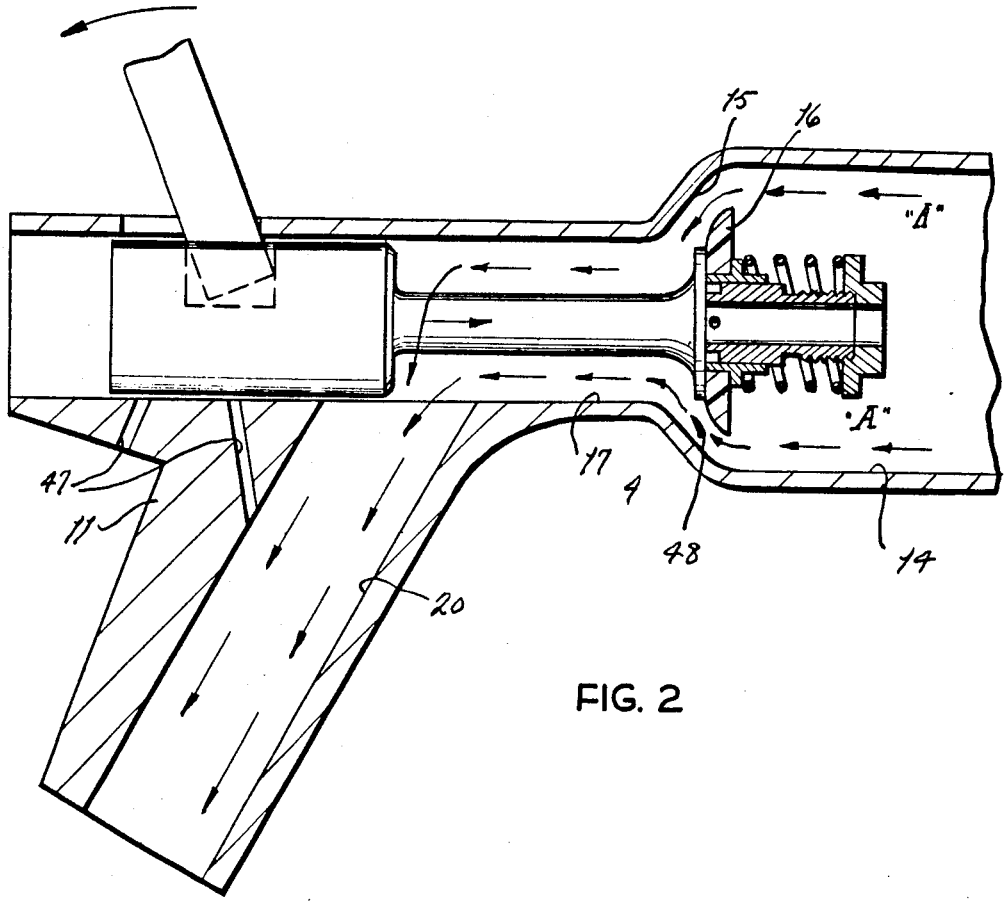
FIG. 2 is a view similar to FIG. 1 except that the valve is in full forward open position to dispense flat beer.

The faucet 10 is designed to dispense flat beer from the position of FIG. 2 and to dispense a thick, creamy foam which is stable (even when light-type beers are being dispensed) from the position of FIG. 3.

FIG. 1 shows the tap in its shut-off position. The handle 12 is in its vertical or neutral position with the valve seat 16 seated against the internal shoulder 15. This seals the main passage 17 from the enlarged chamber 14 which is connected to beer supply. Accordingly, no beer can pass the valve seat 16 and enter the dispensing port 20.

To dispense regular or flat beer, the handle 12 is pulled forward (toward the left in FIGS. 1, 2 and 3) to shift the faucet shaft 13 longitudinally toward the right to the position shown in FIG. 2. In this position, the valve seat 16 is moved away from the shoulder 15 to open a passageway 48 therebetween (FIG. 2). This allows beer to flow unimpededly from the beer source in the chamber 14, through the passage 48, along the main passage 17, and out the dispensing port 20. This flow is depicted by the arrow "A" in FIG. 2.

When it is desired to dispense foam, the handle 12 is moved backward to the position of FIG. 3, which shifts the stem 25 longitudinally to the left. This engages the valve seat 16 in sealing engagement with the shoulder 15. The end cap 39 compresses the return spring 38 against the spring retainer 36. The tubular member 30 moves longitudinally leftward to open a cylindrical chamber to the flow of beer through the internal 31 and the ports 33. The ports 33 have a size of from about 0.02 to about 0.06 inches in diameter. The beer in this chamber (designated by the numeral 50 in FIG. 3) has less pressure than the 12–15 p.s.i. of the beer in the storage receptacle because of the pressure drop across the ports 33. The beer in the chamber 50 is forced through the orifices 28 in the valve seat retaining flange 27 at increased velocity as the orifices 28 are smaller in diameter than the ports 33. From the orifices 28, the beer moves into the main passage 17 where it draws air through the vents 47 by a Venturi type effect. Air also enters the main passage 17 beside the loose fit of the faucet shaft guide 19 in the body chamber 18. When the beer is forced around the turn from the main passage 17 into the dispensing port 20, it is intimately mixed with the air and the foam is formed into small stable bubbles which deposit a smooth, creamy, stable head on a glass of flat beer. The beer flow is indicated diagrammatically by the arrows "B" in FIG. 3.

To stop the formation of foam, the valve mechanism, is returned to the positions of FIGS. 1 or 2.

Thus, it is seen that the present invention achieves all of the objectives and advantages sought theretofore. This application is intended to cover all changes and modifications and variations of the examples herein chosen for purposes of the disclosure which do not constitute departures from the spirit and scope of the invention.

What is claimed is:

1. A faucet for dispensing malt beverages comprising a faucet housing having a discharge port, said faucet housing being connectable to a cource of malt beverage, and valve means in the faucet housing shiftable between shut-off, full flow flat beer dispensing and restricted flow foam dispensing positions, said housing including a chamber, a main passage of smaller cross-sectional area than said chamber and connected thereto, an internal shoulder at the connection, and a guide chamber aligned with said main passage and separated from the main chamber by the discharge port, said housing being provided with air inlet means for admitting air into the dishcharge port to vent the housing when the valve means is in the shut-off position and for incorporation into the malt beverage as it is dispensed after it leaves the said chamber and enters the discharge port when the valve means is in the restricted flow foam dispensing position, said valve means including a guide member shiftable in the guide chamber and loosely positioned therein, a reduced shaft connecting the guide member and a valve seat retaining flange, the flange being freely reciprocable with the meain passage between a position generally concentric with respect to the internal shoulder and a position shifted into the main passage to define a cylindrical chamber, a hollow stem terminating at the flange and positioned in the said chamber, and a valve seat movable with and relative to the stem and adapted to engage the internal shoulder when the valve means is in shut-off and foam dispensing positions, the hollow stem being provided with discharge ports adjacent to the flange, the ports being sealed by the valve seat when the valve is in shut-off and flat beverage dispensing positions and being open when the valve is in foam dispensing position to admit malt beverage transversely into the cylindrical chamber adjacent to the flange, the flange being provided with a series of small orifices therethrough at its periphery whereby the malt beverage discharges from the cylindrical chamber into the main passage and has an increased velocity as it enters the main passage longitudinally from the orifices, said velocity being sufficient to draw air through the air inlet means and past the loosely positioned guide member into the housing and incorporate it into the malt beverage to form a thick, creamy, stable foam.

2. The faucet of claim 1 wherein the discharge port is positioned at about 60° with respect to the main passage whereby the foaming beverage from the flange orifices is further mixed with air and the foam bubble size is reduced to stabilized the foam.

3. The faucet of claim 1 wherein the plate openings are of 0.01 to 0.04 inches in diameter.

* * * * *